United States Patent [19]

Palmer

[11] Patent Number: 4,635,554

[45] Date of Patent: Jan. 13, 1987

[54] DEMOLITION DEVICE AND METHOD OF PREPARING SAME

[75] Inventor: Malcolm G. Palmer, Blakedown, United Kingdom

[73] Assignee: Compact Energy Limited, Worcestershire, United Kingdom

[21] Appl. No.: 682,542

[22] Filed: Dec. 17, 1984

[30] Foreign Application Priority Data

Dec. 22, 1983 [GB] United Kingdom ..... 8334225

[51] Int. Cl.[4] ..... F42B 22/26

[52] U.S. Cl. ..... 102/416; 102/411; 102/420

[58] Field of Search ..... 102/416, 419, 420, 421, 102/417, 406, 411

[56] References Cited

U.S. PATENT DOCUMENTS

| | | | |
|---|---|---|---|
| 2,947,249 | 8/1960 | Vogt et al. | 102/406 |
| 3,735,703 | 5/1973 | Bayer et al. | 102/416 |
| 3,827,359 | 8/1974 | Daughenbaugh | 102/406 |
| 3,863,568 | 2/1975 | Frederick | 102/411 |
| 4,369,709 | 1/1983 | Backstein et al. | 102/420 |
| 4,433,626 | 2/1984 | Landström | 102/417 |

FOREIGN PATENT DOCUMENTS

| | | |
|---|---|---|
| 578990 | 5/1946 | United Kingdom . |
| 583222 | 12/1946 | United Kingdom . |
| 801892 | 9/1958 | United Kingdom . |
| 1366064 | 9/1974 | United Kingdom . |

OTHER PUBLICATIONS

Jane's Defense Review, "Practice Limpet Mine", vol. 3, No. 4, p. 422, 1982.

*Primary Examiner*—Charles T. Jordan

*Attorney, Agent, or Firm*—Marshall, O'Toole, Gerstein, Murray & Bicknell

[57] ABSTRACT

An underwater demolition device has magnets for holding the device on a ferrous structure and a plunger which, once the device has been planted, is held in a retracted position by the structure on which the device is held. If the device is moved from the structure, the plunger protrudes beyond the magnets. A visual indication is provided immediately upon arming of the device if the plunger is then in its protruding position and a timer is provided to prevent detonation until a predetermined delay has elapsed from arming.

11 Claims, 4 Drawing Figures

DEMOLITION DEVICE AND METHOD OF PREPARING SAME

BACKGROUND OF THE INVENTION

From one aspect, the present invention relates to an underwater demolition device of the kind, hereinafter called the kind specified, comprising holding means for holding the device on a ferrous structure, an explosive charge, a detonator and control means for applying to the detonator at a selected time a firing signal to which the detonator responds by detonating the charge.

It is usual to establish between the charge, the detonator and control means of a device of the kind specified a relation in which the control means can fire the detonator to detonate the charge, that is to arm the device, only shortly before use.

The invention also relates to a combination of components of a device of the kind specified which are combined when these components are manufactured and are then transported and stored separately from at least the detonator, prior to use.

SUMMARY OF THE INVENTION

According to a first aspect of the invention, there is provided a device of the kind specified having signalling means which, after arming of the device, is responsive to movement of the device away from a structure with which the device is in contact when armed by providing a movement signal and having indicating means operatively associated with the signalling means and adapted to provide a visual indication that said movement has occurred when the movement signal is applied to the indicating means.

Arming of the device may include establishing a required positional relation between the charge, the detonator and the control means and also establishing an electrical connection between the detonator and the control means. Arming may be carried out in two or more stages, establishment of the electrical connection by closing of a switch being the final stage.

Additionally or alternatively, the movement signal may be applied to the control means to override a prior selection of the time at which the firing signal is to be applied to the detonator.

In a case where the control means has terminals at which the firing signal is presented, and the detonator is connected with these terminals, the terminals may be so positioned relative to the holding means and the signalling means that the terminals are exposed at and are readily accessible from one side of the device, the holding means is arranged for holding the device on a flat plate with said one side of the device against the plate so that the plate conceals the terminals and prevents access thereto, and the signalling means are arranged to respond to movement of the device away from the plate. With this arrangement, when the device has been placed with said one side against a plate and then armed, any attempt to gain access to the terminals will result in generation of the movement signal which may bring about detonation of the charge, either immediately or after a delay.

According to a further aspect of the invention, there is provided a method of preparing a device of the kind specified wherein the holding means, control means and a carrier for the explosive charge are assembled together to form a unit which is stored and transported whilst devoid of an explosive charge and wherein the charge and the detonator are mounted in the carrier during arming of the device.

BRIEF DESCRIPTION OF THE DRAWINGS

An example of a device in accordance with the invention and which is prepared by a method in accordance with the invention will now be described, with reference to the accompanying drawings, wherein.

DESCRIPTION OF THE PREFERRED EMBODIMENTS

Figure 1:
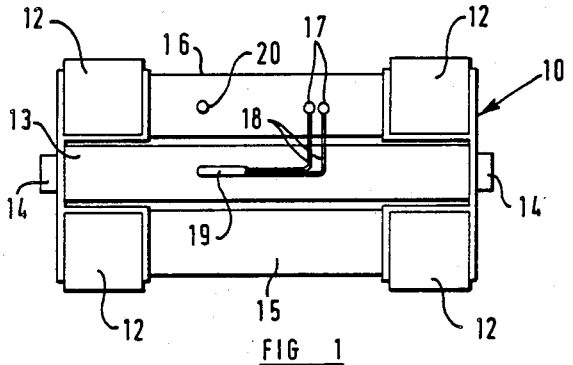
FIG. 1 shows a rear elevation of the device.
Figure 2:
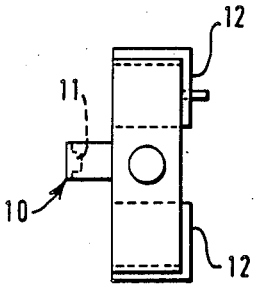
FIG. 2 shows an end elevation of the device.

The device illustrated in the drawings comprises a carrier 10 in the form of a frame having a handle 11. Holding means for holding the device on a ferrous structure are mounted on the carrier. The holding means consists of permanent magnets 12 and four magnets are provided in the example illustrated. These are arranged at the corners of a rectangle and have respective pole faces which are coplanar and which lie at one side of the device, called herein the rear of the device.

An explosive charge 13 is removably mounted in the carrier 10 by means of screws 14 which extend through respective apertures in the carrier into a plastics envelope of the charge. Other fasteners or alternative arrangements may be used for securing the charge in the carrier. There are also mounted in the carrier a float 15 and control means 16. The float reduces the weight of the device, when submerged in water, and thus makes the device easier to carry. However, the float may be omitted, if not required.

The control means 16 comprises a water-tight housing, at the outside of which is a pair of electrical terminals 17 which are connected by flexible leads 18 with a detonator 19 attached to or embedded in the charge 13. It will be noted that the terminals, the leads 18 and the detonator all lie at the rear side of the device and are inaccessible, except from the rear of the device.

The control means further comprises signalling means 20 for providing a movement signal when, after arming, the device is moved away from a structure with which the device is initially in contact at its rear side. The signalling means comprises an electrical switch having an operating member which projects from the housing of the control means 16 rearwardly of the device to contact a structure at the rear of the device against which the device is held. When the operating member projects beyond the plane containing the pole faces of the magnets 12, the switch of the signalling means 20 is closed. The switch can be opened by depressing the operating member in a direction forwardly of the device until the tip of the operating member lies in the plane containing the pole faces of the magnets. The operating member of the signalling means also is accessible only from the rear of the device. The remainder of the signalling means is inaccessible because it is inside the housing.

Figure 3:
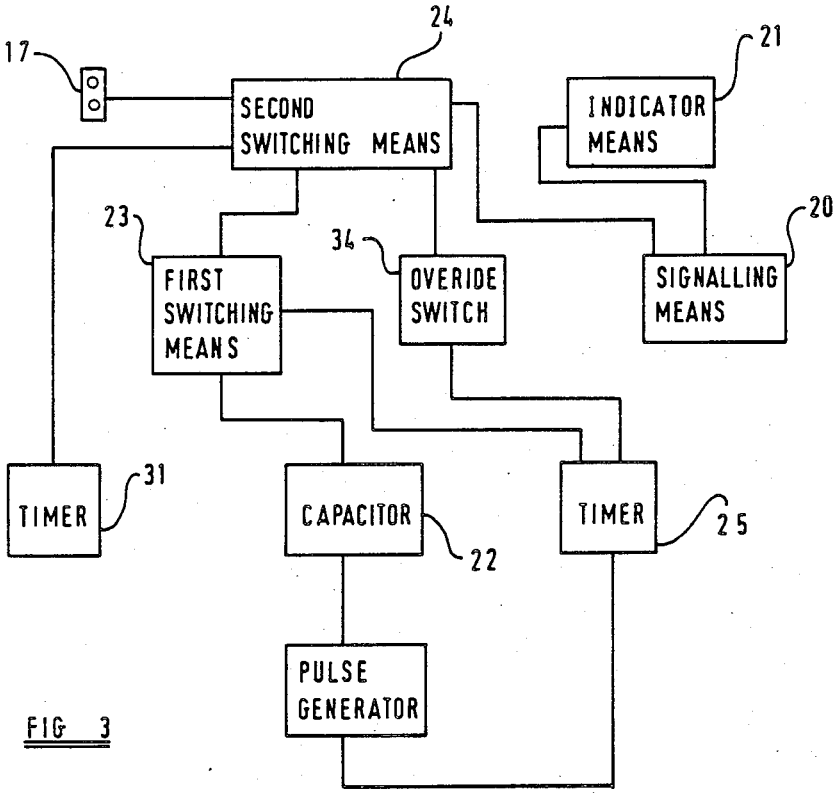
FIG. 3 is a block diagram of a circuit of the device.

As shown in FIG. 3, the signalling means 20 is connected electrically with indicator means 21 which is adapted to provide a visual signal to a user when the operating member of the signalling means projects beyond the plane containing the pole faces of the magnets 12, after the device has been armed. The indicator means comprises a light-emitting diode or other light source which is visible from the front of the device through a transparent panel in the housing of the control means 16.

The control means 16 includes a capacitor 22 from which a firing signal can be conducted to the terminals 17 to fire a detonator connected to the terminals. There is connected in series with the capacitor and terminals first and second switching means 23 and 24 respectively. The first and second switching means are normally in a non-conducting condition and therefore both prevent conduction of the firing signal to the terminals.

A time 25 is included in the control means for setting the first switching means 23 in a conducting condition after elapse of a predetermined interval from arming of the device. Typically, this interval would be twenty five minutes. Conduction of the firing signal to the terminals 17 is therefore prevented until this predetermined interval has elapsed from arming of the device.

The signalling means 20 is arranged to apply the movement signal to the second switching means 24 to set the second switching means in a conducting condition. Accordingly, if the operating member projects beyond the plane containing the pole faces of the magnets 12 when the predetermined interval elapses, or the operating member moves into such a position after the predetermined period has elapsed, both of the switching means will become conducting and allow the firing signal to pass from the capacitor 22 to the terminals 17.

The control means 16 includes an arming switch 26 which has a number of sets of contacts. One of these sets, 27, is normally closed and is connected across the capacitor 22 to prevent charging of the capacitor before the device is armed. A parallel pair of resistors $R_{13}$, $R_{18}$ is connected in series with the contacts 27. The timer 25 has a pulse generator adapted to supply charging pulses to the capacitor 22 after the elapse of the predetermined interval, but not earlier. The arrangement is such that charge is applied to the capacitor 22 by an edge of each current pulse from the pulse generator. However, the capacitor cannot be charged by a continuous current. This ensures that malfunction of the timer 25 is unlikely to result in charging of the capacitor 22 before elapse of the predetermined interval. Electrical energy is supplied to the timer 25 from a main battery 28 of the device through a main switch 29 and contacts 30 of the arming switch. The main switch (not shown) is accessible only from the rear of the device.

The control means 16 includes a further timer 31 powered by a separate battery 32 through additional poles 33 of the main switch. This timer is adapted to set the second switching means 24 in a conducting condition when the values stored in first and second registers of the timer coincide. Means (not shown) is provided for entering a selected value in the first of these registers. The value in the second of the registers is incremented in accordance with the passage of time from a datum value which may be entered in the second register. Thus, the value in the second register may correspond to Greenwich Mean Time or to some other local time and there may be applied through the first register a value corresponding to the actual time at which the charge is to be detonated. Alternatively, the datum value entered into the second register may be zero so that the value in the second register will represent elapsed time and the value entered in the first register will then represent the time delay before firing of the charge.

The control means 16 includes a liquid crystal or other display which can be seen through the transparent panel of the control means housing and in which the contents of either register of the timer 31 can be displayed.

The control means 16 also includes an override switch 34 which is normally held in a first condition by a removable pin (not shown) accessible at the front of the device. In its first condition, the override switch provides a connection between, on the one hand, the second switching means 24 and, on the other hand, the timer 31 and the signalling means 20. In its second condition, which is represented in FIG. 3, the override switch provides a connection between the timer 25 and the second switching means so that the timer 25 is able to set both the first and second switching means into a conducting condition. The override switch 34 is changed automatically into its second condition when its pin is withdrawn and is not then accessible so that it cannot be returned to its first condition.

Figure 4:
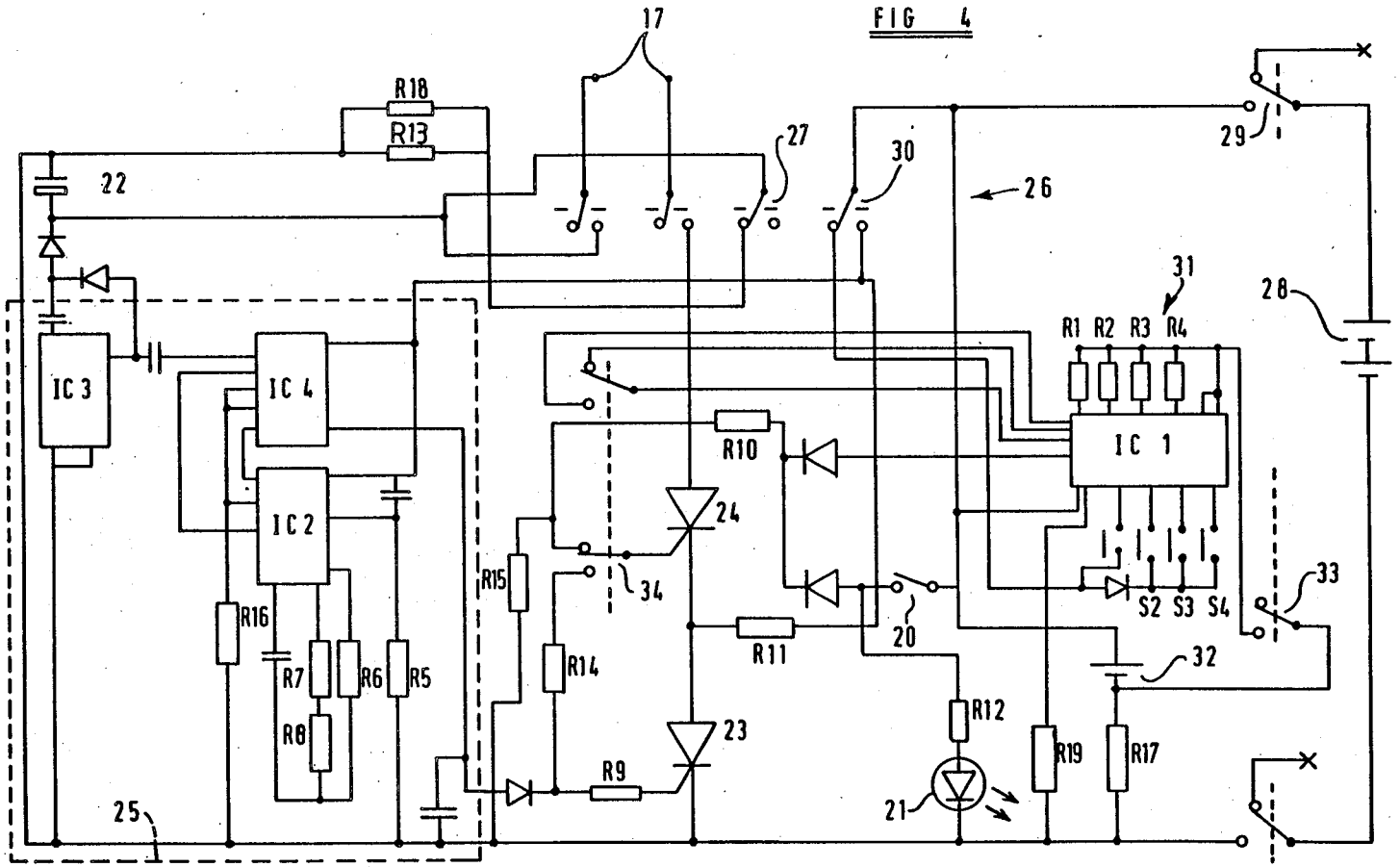
FIG. 4 is a circuit diagram of the device.

The first and second switching means 23 and 24 are preferably semiconductor devices, for example thyristors, as shown in FIG. 4.

The device illustrated in the drawings would normally be manufactured without the charge 13 and detonator 19. The magnets 12, float 15 and control means 16, including the signalling means 20, are assembled on the carrier 10 to form a unit which is transported and stored separately from the charge. The carrier is preferably adapted to received a standard charge which is in common use at the present time. The charge can be stored in a magazine without space in that magazine being occupied by the unit which includes the carrier 10.

When the device is to be used, the charge 13 is secured to the carrier 10 by the screws 14. The detonator may be connected to the terminals 17 and embedded in the charge at the same time or the detonator may be applied subsequently. The device, including the charge 13 but not necessarily including the detonator 19, is carried to the site where it is to be used. After the detonator has been applied, the rear of the device is presented to a ferrous structure so that the device is drawn into contact with, and is held in contact with, the structure by the magnets 12. Before the device contacts the structure, the operating member of the signalling means 20 projects beyond the plane containing the pole faces of the magnets 12. As the device is drawn into contact with the ferrous structure, the operating member engages that structure and is depressed until its tip is coplanar with the pole faces of the magnets. No other part of the device projects beyond the plane containing the pole faces of the magnets. The signalling means 20 is thus set in a non-conducting condition.

The registers of the timer 31 are set, either before of after the device has been applied to the ferrous structure, but before the device is armed. When the device is armed, by means of the arming switch, the setting controls of the timer 31 are disabled so that the contents of the registers cannot be changed. Operation of the arming switch also closes switch contacts between one of the terminals 17 and the capacitor 22 and the other of the terminals 17 and the second switching means 24. As previously mentioned, operation of the arming switch also energises the timer 25.

The arming switch 26 has a handle (not shown) which is accessible from the front of the device. Means is provided for preventing transmission of torque from the handle to the contacts of the switch 26, once the arming switch has been set from its normal condition into a condition in which the contact 27 are open. This means may comprise a spring-loaded detent (not shown) which moves into engagement with an abutment of the arming switch when the device is armed, so preventing subsequent rotation of the handle of the switch. Alternatively, means may be provided for discontinuing a connection between the handle of the switch and the switch contacts.

After the elapse of a delay determined by the timer 25, the application of charging pulses to the capacitor 22 is commenced. Within a few minutes, the charge on the capacitor is sufficient to fire the detonator. After elapse of a slightly longer interval from operation of the arming switch, the timer 25 applies a signal to the first switching means 23 to set this switching means in a conducting condition. If the override switch 34 has already been operated, this signal will also be applied to the second switching means 24, with the result that the firing signal will be applied to the detonator.

If the override switch 34 has not been operated, the second switching means will normally remain in a non-conducting condition for some time after the first switching means has assumed a conducting condition. If, after the elapse of further time, the values in the registers of the timer 31 coincide, the timer 31 then applies to the second switching means a signal which turns this switching means on so that the firing signal is applied to the detonator.

Prior to coincidence of the values in the registers of the timer 31 being achieved, but after operation of the arming switch 26, and when the first switching means 23 has become conducting, if the device is moved in a direction away from the ferrous structure to which it is held by the magnets 12, the signalling means 20 will operate to turn the second switching means on and permit the firing signal to be applied to the detonator.

The charge 13 can be inserted into the carrier 10 and withdrawn therefrom only at the rear of the device. Thus, once the device has been planted on a structure and the predetermined interval has elapsed after arming, the charge cannot be removed without detonation.

If the device is not applied to a substantially flat, imperforate surface of the ferrous structure, there is a possibility of the operating member of the signalling means 20 remaining in its projected position when the device is held on the structure by the magnets. In this event, when the arming switch is operated, the movement signal will be applied to the indicator means 21 to alert the user to the condition of the signalling means. Because there is available from the timer 25, just after operation of the arming switch, no signal which can establish a conducting condition of the first and second switching means, the device can be moved safely within a few minutes of operation of the arming switch.

In a case where the device is to be used on a non-ferrous structure, the magnets 12 may be substituted by other holding means, for example suction devices.

If additional charges are to be detonated in close proximity to the charge of the device illustrated in the drawings, one or more additional charges mounted in carriers similar to the carrier 10 and provided with holding means can be coupled with the charge 13 by means of detonating cord. The screws 14 may be of tubular form so that detonating cord can pass through them.

If required, the signalling means 20 may be provided with a removable pin which holds the operating member of the signalling means in a retracted position until the pin is removed.

I claim:

1. An underwater demolition device comprising holding means for holding the device on a ferrous structure, an explosive charge, a detonator, control means for applying to the detonator at a selected time a firing signal to which the detonator responds by detonating the charge, signalling means which, after arming of the device, is responsive to movement of the device away from a structure with which the device is in contact when armed by providing a movement signal and indicating means distinct from but operatively associated with the signalling means and adapted to provide a visual signal that said movement has occurred when the movement signal is applied to the indicating means.

2. An underwater demolition device comprising holding means for holding the device on a ferrous structure, an explosive charge, a detonator, control means for applying to the detonator at a selected time a firing signal to which the detonator responds by detonating the charge, signalling means which, after arming of the device, is responsive to movement of the device away from a structure with which the device is in contact when armed by providing a movement signal and indicating means operatively associated with the signalling means and adapted to provide a visual signal that said movement has occurred when the movement signal is applied to the indicating means wherein the control means comprises terminals at which the firing signal is presented, the detonator is connected with said terminals and said terminals are so positioned relative to the holding means, the control means and the charge that the terminals are exposed at and are readily accessible from one side of the device and the signalling means is adapted to respond to movement of said device away from a structure at said one side of the device.

3. A device according to claim 2 wherein the detonator is accessible from one side of the device and the signalling means is adapted to respond to movement of the device away from a structure at said one side of the device.

4. An underwater demolition device comprising holding means for holding the device on a ferrous structure, an explosive charge, a detonator, control means for applying to the detonator at a selected time a firing signal to which the detonator responds by detonating the charge, signalling means which, after arming of the device, is responsive to movement of the device away from a structure with which the device is in contact when armed by providing a movement signal and indicating means operatively associated with the signalling means and adapted to provide a visual signal that said movement has occurred when the movement signal is applied to the indicating means wherein the control means comprises terminals at which the firing signal is presented, the detonator is connected with said terminals and said terminals are so positioned relative to the holding means, control means and charge that the terminals are exposed at and are readily accessible from one side of the device and the holding means is adapted to hold the device on a flat plate with said one side of the device against the plate so that the plate conceals the terminals and prevents access thereto.

5. An underwater demolition device comprising holding means for holding the device on a ferrous structure, an explosive charge, a detonator, control means for applying to the detonator at a selected time a firing signal to which the detonator responds by detonating the charge, signalling means which, after arming of the device, is responsive to movement of the device away from a structure with which the device is in contact when armed by providing a movement signal and indicating means distinct from but operatively associated with the signalling means and comprising a light source adapted to provide a visual signal that said movement has occurred when the movement signal is applied to the indicating means.

6. A device according to claim 5 further comprising terminals for connection of a detonator with the control means, wherein the control means comprises a source of said firing signal, first switching means and second switching means, said first and second switching means being connected in series between said source and said terminals, the device further comprising means for setting the first switching means in a conducting condition after elapse of a predetermined interval from arming of the device and the device comprising means for responding to the movement signal by setting the second switching means in a conducting condition.

7. A device according to claim 6 further comprising a settable timer for setting said second switching means in a conducting condition after a selected delay.

8. A device according to claim 6 wherein said source of the firing signal is a capacitor and wherein the control means further comprises means for applying electrical charge to the capacitor and a safety timer for preventing application of charge to the capacitor until there has elapsed a predetermined period from arming of the device.

9. A combination comprising holding means for holding the combination on a ferrous structure, a carrier for an explosive charge, a detonator, control means for applying to the detonator at a selected time a firing signal to which the detonator responds by detonating a charge, when present in the carrier, and terminals for connection of the detonator with the control means, wherein the control means comprises a source of a firing signal for application to said terminals, first switching means and second switching means and signalling means for providing a movement signal when movement of the combination away from a structure at one side of the combination occurs, said first and second switching means being connected in series between said source and said terminals, the device further comprising means for setting said first switching means in a conducting condition after a lapse of a predetermined interval from arming of the combination and means for responding to the movement signal by setting the second switching means in a conducting condition.

10. A combination according to claim 9 wherein said control means further comprises a settable timer for setting the second switching means in a conducting condition after a selected delay.

11. A combination according to claim 9 wherein said source of the firing signal is a capacitor, the control means further comprises means for applying electrical chage to the capacitor and the control means comprises a safety timer for preventing application of charge to the capacitor until there has elapsed a predetermined period from arming of the combination.

* * * * *